US009395159B2

(12) United States Patent
McElfresh et al.

(10) Patent No.: US 9,395,159 B2
(45) Date of Patent: Jul. 19, 2016

(54) EMBEDDED-MONOLITH ARMOR

(75) Inventors: Michael W. McElfresh, Livermore, CA (US); Scott E. Groves, Brentwood, CA (US); Mitchell L. Moffet, Tracy, CA (US); Louis P. Martin, San Ramon, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 260 days.

(21) Appl. No.: 13/410,140

(22) Filed: Mar. 1, 2012

(65) Prior Publication Data

US 2013/0228067 A1 Sep. 5, 2013

(51) Int. Cl.
*F41H 5/04* (2006.01)

(52) U.S. Cl.
CPC ..... *F41H 5/0457* (2013.01); *F41H 5/0492* (2013.01)

(58) Field of Classification Search
USPC ..... 89/36.01–36.17, 903–917; 2/2.5; 428/911; 109/49.5
See application file for complete search history.

(56) References Cited

U.S. PATENT DOCUMENTS

| | | | | | |
|---|---|---|---|---|---|
| 3,431,818 | A * | 3/1969 | King | 89/36.02 |
| 3,573,150 | A * | 3/1971 | Broutman et al. | 428/105 |
| 4,948,764 | A | 8/1990 | Newkirk et al. | |
| 5,114,772 | A | 5/1992 | Vives et al. | |
| 5,361,678 | A * | 11/1994 | Roopchand et al. | 89/36.02 |
| 5,516,595 | A | 5/1996 | Newkirk et al. | |
| 5,738,925 | A * | 4/1998 | Chaput | 428/101 |
| 5,804,757 | A * | 9/1998 | Wynne | 89/36.05 |
| 6,253,655 | B1 * | 7/2001 | Lyons et al. | 89/36.02 |
| 6,289,781 | B1 | 9/2001 | Cohen et al. | |
| 6,389,594 | B1 | 5/2002 | Yavin et al. | |
| 6,895,851 | B1 | 5/2005 | Adams et al. | |
| 6,955,112 | B1 | 10/2005 | Adams et al. | |
| 8,096,223 | B1 * | 1/2012 | Andrews | 89/36.02 |
| 2006/0243127 | A1 | 11/2006 | Cohen et al. | |
| 2009/0095147 | A1 * | 4/2009 | Tunis et al. | 89/36.02 |
| 2009/0114083 | A1 * | 5/2009 | Moore et al. | 89/36.02 |
| 2009/0126557 | A1 * | 5/2009 | Hunn | 89/36.02 |
| 2009/0320676 | A1 * | 12/2009 | Cronin et al. | 89/36.05 |
| 2010/0011949 | A1 | 1/2010 | Ravid et al. | |
| 2010/0294123 | A1 * | 11/2010 | Joynt et al. | 89/36.02 |

* cited by examiner

*Primary Examiner* — Stephen M Johnson
*Assistant Examiner* — Benjamin Gomberg
(74) *Attorney, Agent, or Firm* — Eddie E. Scott

(57) ABSTRACT

A lightweight armor system utilizing a face section having a multiplicity of monoliths embedded in a matrix supported on low density foam. The face section is supported with a strong stiff backing plate. The backing plate is mounted on a spall plate.

2 Claims, 10 Drawing Sheets

EMBEDDED-MONOLITH ARMOR

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

1. Field of Endeavor

The present invention relates to armor and more particularly to embedded monolith armor.

2. State of Technology

Humans throughout recorded history have used various types of materials as body armor to protect themselves from injury in combat and other dangerous situations. The first protective clothing and shields were made from animal skins. As civilizations became more advanced, wooden shields and then metal shields came into use. Eventually, metal was also used as body armor, what we now refer to as the suit of armor associated with the knights of the Middle Ages. However, with the invention of firearms around 1500, metal body armor became ineffective.

United States Patent and Trademark Office records dating back to 1919 lists various designs of bullet proof vests and body armor type garments. One of the first documented instances where such a garment was demonstrated for use by law enforcement officers was detailed in the Apr. 2, 1931 edition of the Washington, D.C., Evening Star, where a bullet proof vest was demonstrated to members of the Metropolitan Police Department.

The next generation of anti-ballistic bullet proof vest was the World War II "flak jacket" made from ballistic nylon. The flak jacket provided protection primarily from ammunitions fragments and was ineffective against most pistol and rifle threats. Flak jackets were also very cumbersome and bulky.

It would not be until the late 1960s that new fibers were discovered that made today's modern generation of cancelable body armor possible. The National Institute of Justice or NIJ initiated a research program to investigate development of a lightweight body armor that on-duty policemen could wear full time. The investigation readily identified new materials that could be woven into a lightweight fabric with excellent ballistic resistant properties. Performance standards were set that defined ballistic resistant requirements for police body armor.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides an armor system wherein a face section having a multiplicity of monoliths embedded in a matrix are supported on a low density foam. This face section is mounted on a strong stiff backing plate which in turn is mounted on a spall plate. The present invention provides a system that is effective in defeating ballistic projectiles. The present invention has use as armor for protecting against bullets and ballistic projectiles produced by bombs or IEDs. The present invention also has use as armor for protecting against fragments from sources such as high speed flywheels. For example, flywheel energy storage (FES) works by accelerating a rotor or flywheel to a very high speed and maintaining the energy in the system as rotational energy. Advanced FES systems have rotors made of high strength carbon filaments, suspended by magnetic bearings, and spinning at speeds from 20,000 to over 50,000 rpm in a vacuum enclosure. When the tensile strength of a flywheel is exceeded the flywheel will shatter, releasing all of its stored energy at once; this is commonly referred to as "flywheel explosion" since wheel fragments can reach kinetic energy exceeding that of a bullet. Consequently, traditional flywheel systems require armor and/or containment vessels as a safety precaution.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF SPECIFIC EMBODIMENTS

Figure 1A:
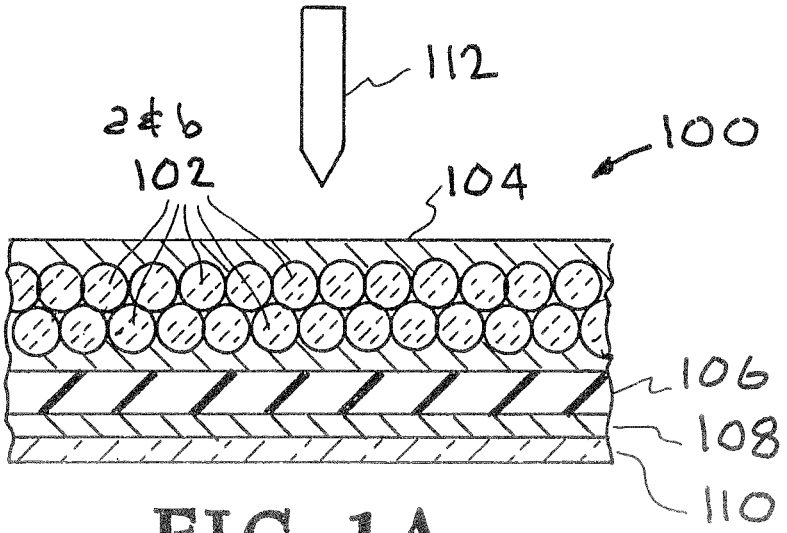
FIGS. 1A, 1B, & 1C illustrate one embodiment of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

The present invention provides an armor system wherein hard materials, like ceramic silicon carbide, in a matrix are supported with a strong stiff backing plate mounted on a low density foam. The low density foam can be made of polyvinyl chloride (PVC), polyurethane, or nylon. The foam can be a foam having pores supporting three to thirty pounds per cubic foot. The hard materials in a matrix supported by a strong stiff backing plate that is mounted on the low density foam are mounted on a metallic backing plate and a spall plate. The armor system of the present invention is effective in defeating ballistic projectiles. The harder the ceramic material the more effective it is at defeating projectiles. An issue for ceramic-faced armor is that after projectile impact the ceramic in the impacted region is destroyed, weakling the armor locally toward additional impacts and limiting its use in those cases where multiple impacts are typical (e.g. shrapnel produced by bombs or IEDs).

In a preferred embodiment, a composite fabricated from hard monoliths (e.g. ceramic) imbedded in a tough matrix (e.g. aluminum alloy or plastic) with the monoliths positioned in a particular pattern. The monoliths are arranged in a stacking arrangement where there is overlapping of the spherical monoliths. This provides full coverage of the front face so that a projectile, such as a bullet or a fragment, can't penetrate the system. The monoliths may be spheres, shells, cylinders, other shapes, or composites and may be designed for more than one defeat mechanism. The dimensions of each component are to be optimized for the specific projectiles to be defeated.

The front face is mounted on a low density foam. This allows movement of the front face when the projectile impacts the front face. The movement reduces the amount of impact damage produced by the projectile. The low density foam also provides a certain amount of rotation of the front face. The rotation is helpful in diverting the trajectory of the projectile passing through an armor component making it easier to defeat at a second catcher stage.

The low density foam is mounted on a metallic backing plate. The metallic backing plate is mounted on a spall plate. The spall plate can be a E-glass spall plate, a Kevlar spall plate, or other spall plate. The system creates an array of hard and soft/tough regions with a length scale similar to that of the projectile to be defeated. Both light weight and the low cost particular placement of hard projectile-defeating structures of specific shape and size embedded in the tough (metal) matrix.

The armor system lends itself to cost reductions in several ways. First, the monoliths incorporated into the armor can be produced at much lower prices than the plates that are currently used with ceramic-faced armor. More importantly, by substituting hard natural occurring minerals for the highly processed ceramic it may be possible to dramatically reduce costs and very possibly improve performance. Examples of the hard natural occurring minerals include flint aggregate and granite aggragate.

Figure 1B:
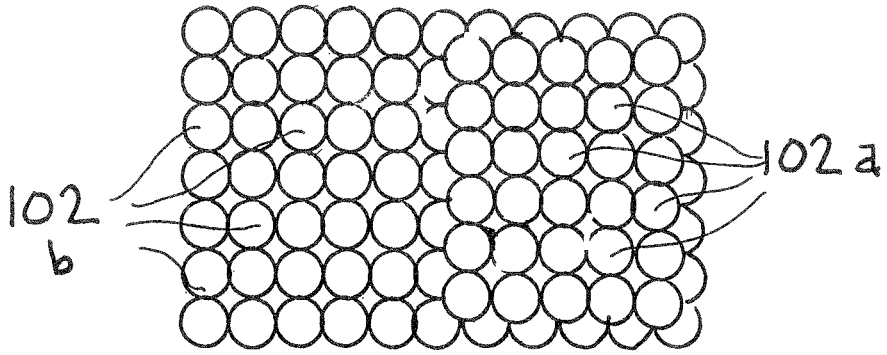
Figure 1C:
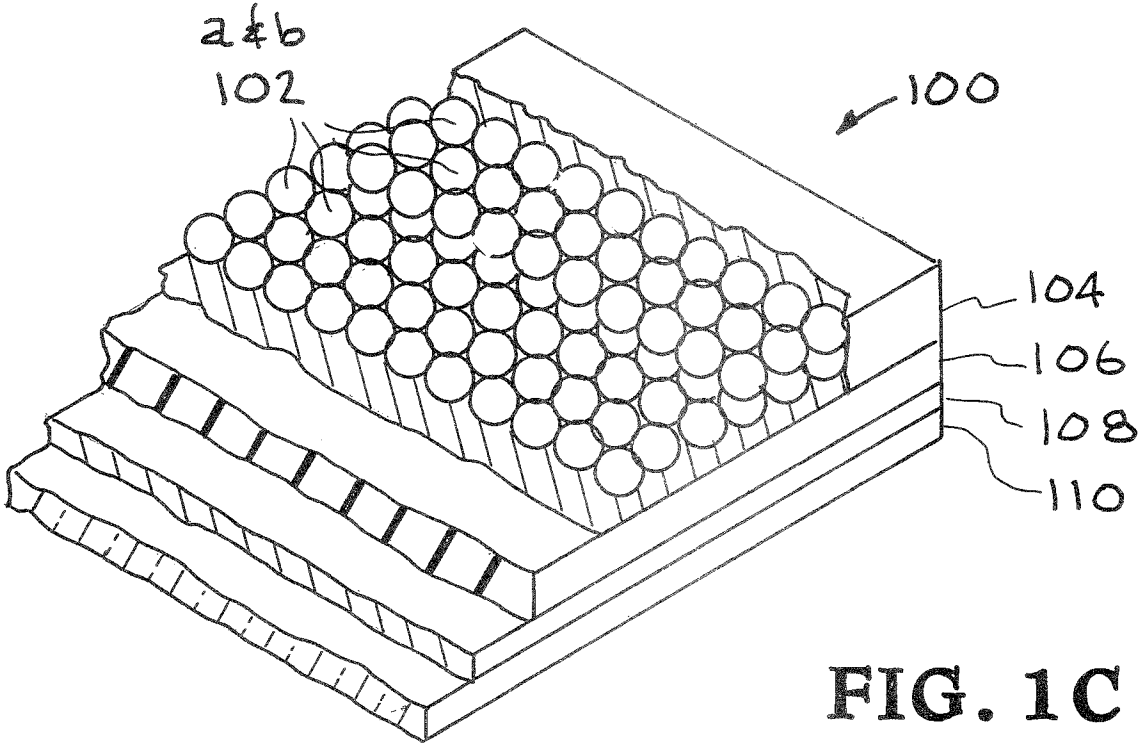

Referring now to the drawings and in particular to FIGS. 1A, 1B, and 1C, a first embodiment of a complete lightweight low-cost armor system is illustrated schematically. The armor system of the first embodiment is designated generally by the reference numeral 100. In the system 100, rather than a ceramic (i.e. hard component) plate facing on the outside, the hard material in the shape of monoliths (102*a* and 102*b*) is embedded in the supporting tough matrix 104.

In the system 100, the front face is a composite fabricated from hard monoliths 102*a* and 102*b* (e.g. ceramic) imbedded in a tough matrix 104 with the monoliths 102*a* and 102*b* positioned in a particular pattern. Examples of the tough matrix 104 include aluminum alloy, plastic, polymer materials, and other tough matrix materials. As shown in FIGS. 1A, 1B, and 1C; spherical monoliths 102*a* and 102*b* are arranged in a stacking arrangement wherein of monoliths 102*a* form one row and monoliths 102*b* form another row. The rows provide overlapping of the spherical monoliths 102*a* and 102*b*. FIGS. 1B and 1C show the spherical monoliths 102*a* and 102*b* nested together in a manner that provides full coverage of the front face so that a projectile, such as a bullet 112, cannot penetrate the system 100. The monoliths 102*a* and 102*b* may be spheres or composites and may be designed for more than one defeat mechanism. The dimensions of each component are optimized for the specific projectiles to be defeated.

The front face is mounted on a low density foam 106. This allows movement of the front face when the projectile 112 impacts the front face. The movement reduces the amount of impact damage produced by the projectile 112. The low density foam 106 also provides a certain amount of rotation of the front face when the projectile 112 impacts the front face. The rotation is helpful in diverting the trajectory of the projectile 112 passing through the armor component making it easier to defeat at the second catcher stage.

The low density foam 106 is mounted on a metallic backing plate 108. The metallic backing plate 108 is mounted on a spall plate 110. The spall plate 108 can be a E-glass spall plate, a Kevlar spall plate, or other spall plate. The system 100 creates an array of hard and soft/tough regions with a length scale similar to that of the projectile to be defeated. Both light weight and the low cost particular placement of hard projectile-defeating structures of specific shape and size embedded in the tough (metal) matrix.

The armor system 100 also lends itself to cost reductions in several ways. First, the monoliths incorporated into the armor can be produced at much lower prices than the plates that are currently used with ceramic-faced armor. More importantly, by substituting natural occurring minerals for the highly processed ceramic it may be possible to dramatically reduce costs and very possibly improve performance.

Figure 2A:
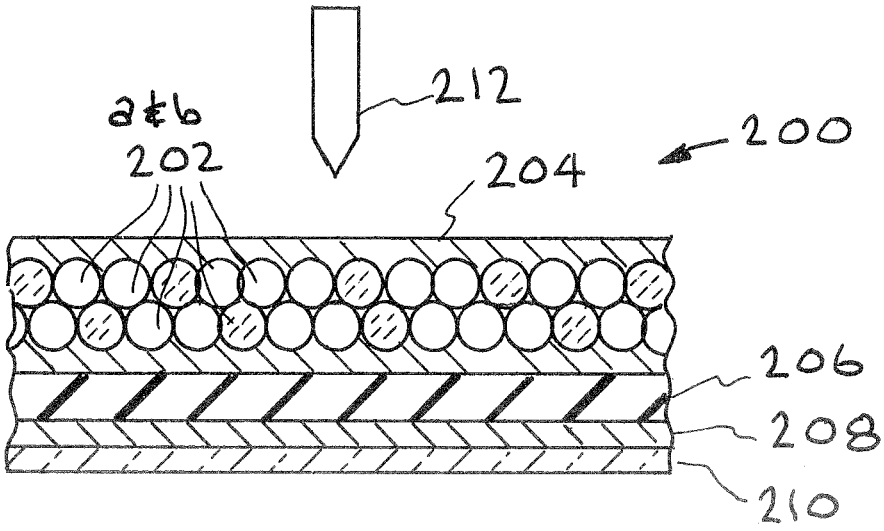
FIGS. 2A, 2B & 2C illustrate another embodiment of the present invention.
Figure 2B:
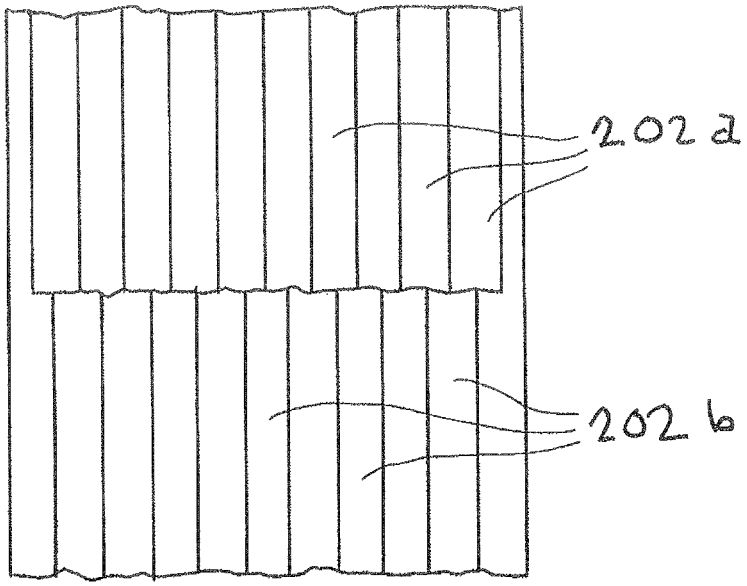
Figure 2C:
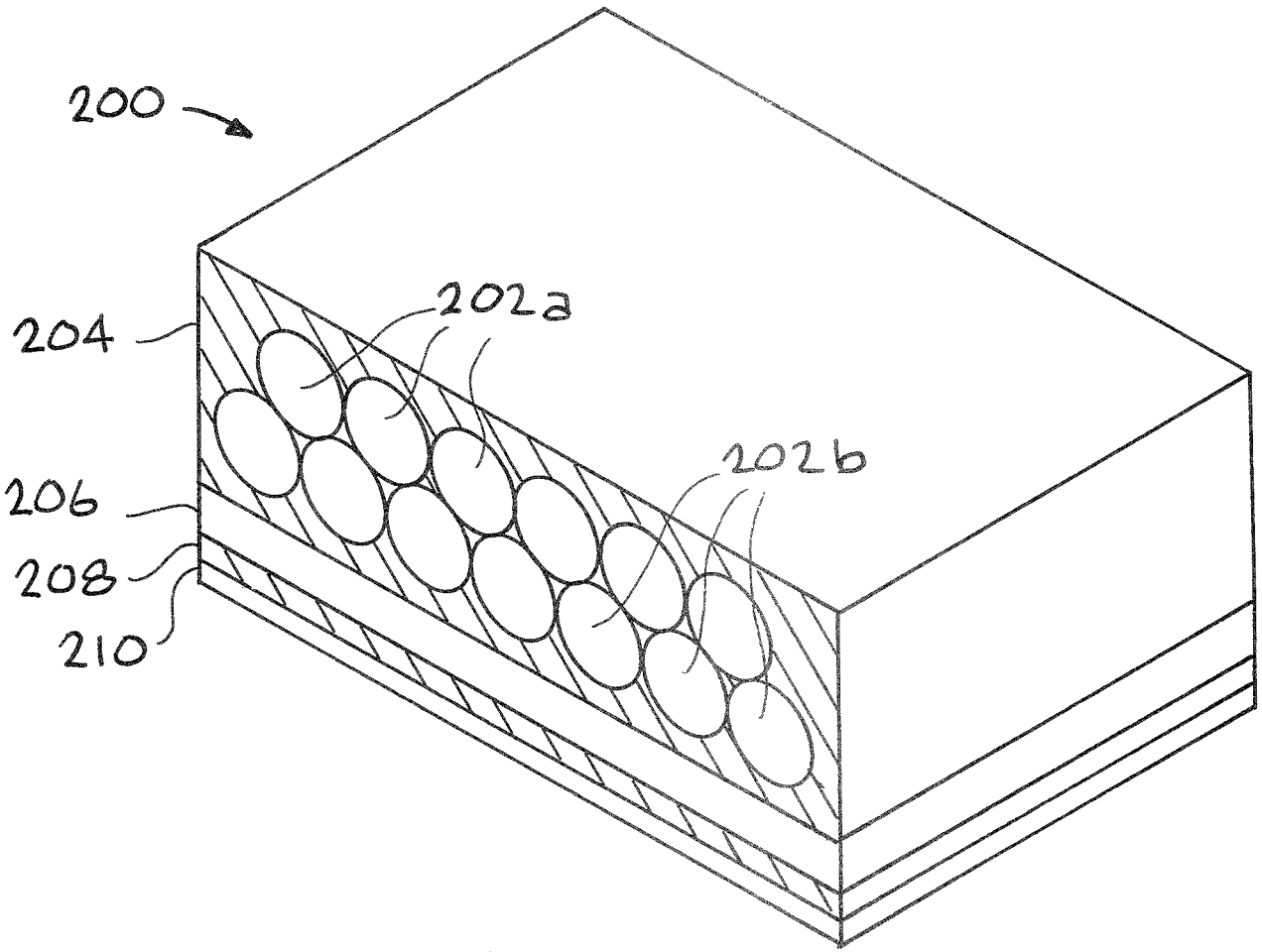

Referring now to FIGS. 2A, 2B, and 2C another embodiment of a complete lightweight low-cost armor system is illustrated schematically. The armor system of this embodiment is designated generally by the reference numeral 200. In the system 200, rather than a ceramic (i.e. hard component) plate facing on the outside, the hard material in the shape of monoliths 202*a* and 202*b* is embedded in the supporting tough matrix 204.

In the system 200, the front face is a composite fabricated from hard monoliths 202*a* and 202*b* (e.g. ceramic) imbedded in a tough matrix 204 (e.g. aluminum alloy) with the monoliths 202*a* and 202*b* positioned in a particular pattern. As shown in FIG. 2A, the cylindrical section monoliths 202*a* and 202*b* are arranged in rows in a stacking arrangement where there is overlapping of the cylindrical section monoliths 202*a* and 202*b*. As shown in FIG. 2B, this provides full coverage of the front face so that a projectile, such as a bullet 212, cannot penetrate the system 200. The monoliths 202*a* and 202*b* may be cylindrical sections or cylinders or composites and may be designed for more than one defeat mechanism. The dimensions of each component are optimized for the specific projectiles to be defeated.

The front face is mounted on a low density foam section 206. This allows movement of the front face when the projectile 212 impacts the front face. The movement reduces the amount of impact damage produced by the projectile 212. The low density foam 206 also provides a certain amount of rotation of the front face when the projectile 212 impacts the front face. The rotation is helpful in diverting the trajectory of the projectile 212 passing through an armor component making it easier to defeat at the second catcher stage.

The low density foam 206 is mounted on a metallic backing plate 208. The metallic backing plate 208 is mounted on a spall plate 210. The spall plate 208 can be an E-glass spall plate, a Kevlar spall plate, or other spall plate. The system 200 creates an array of hard and soft/tough regions with a length scale similar to that of the projectile to be defeated. Both light weight and the low cost particular placement of hard projectile-defeating structures of specific shape and size embedded in the tough (metal) matrix.

The armor system 200 also lends itself to cost reductions in several ways. First, the monoliths incorporated into the armor can be produced at much lower prices than the plates that are currently used with ceramic-faced armor. More importantly, by substituting natural occurring minerals for the highly processed ceramic it may be possible to dramatically reduce costs and very possibly improve performance.

Figure 3A:
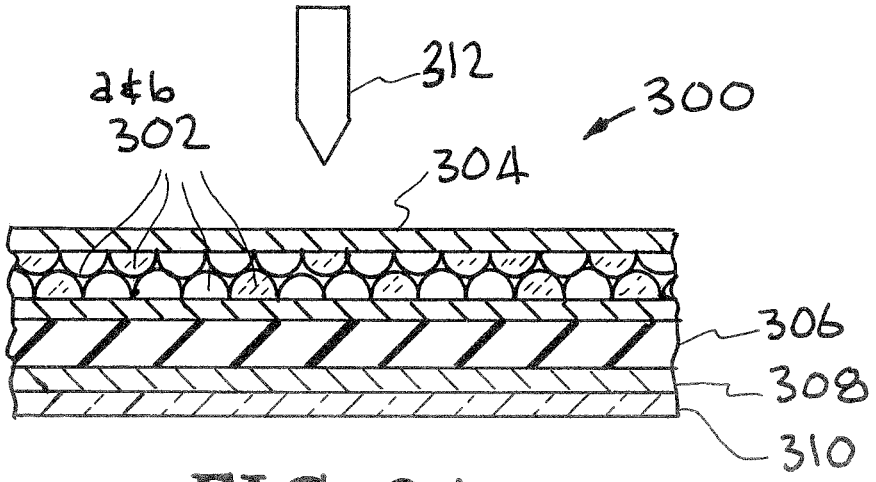
FIGS. 3A, 3B, & 3C illustrate yet another embodiment of the present invention.

Referring now to FIGS. 3A. 3B, and 3C another embodiment of a complete lightweight low-cost armor system is illustrated schematically. The armor system of this embodiment is designated generally by the reference numeral 300. In the system 300, rather than a ceramic (i.e. hard component) plate facing on the outside, the hard material in the shape of monoliths 302*a* and 302*b* is embedded in the supporting tough matrix 304.

Figure 3B:
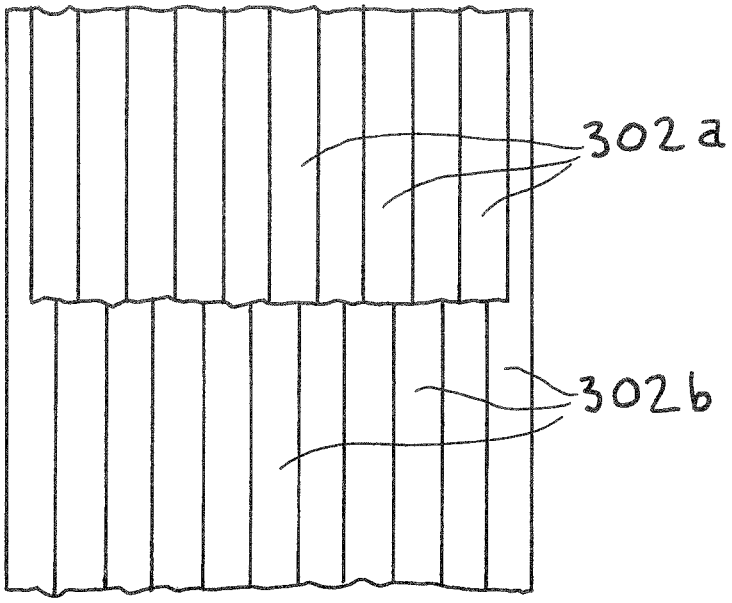
Figure 3C:
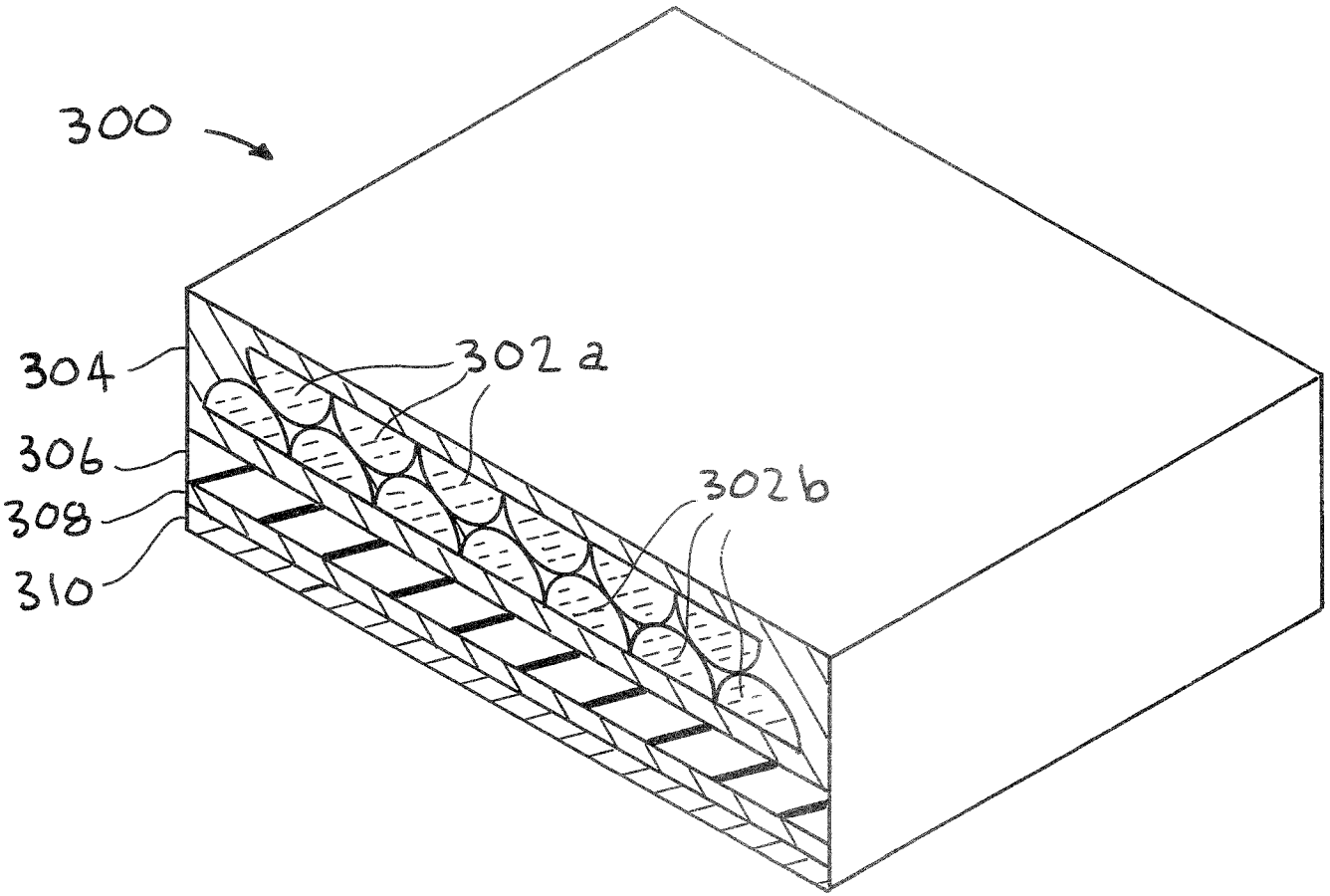

In the system 300, the front face is a composite fabricated from hard monoliths 302*a* and 302*b* (e.g. ceramic) imbedded in a tough matrix 304 (e.g. aluminum alloy) with the monoliths 302*a* and 302*b* positioned in a particular pattern. As shown in FIG. 3A, the half cylinder section monoliths 302*a* and 302*b* are arranged in rows in a stacking arrangement where there is overlapping of the half cylinder section monoliths 302*a* and 302*b*. As shown in FIG. 3B, this provides full coverage of the front face so that a projectile, such as a bullet 312, cannot penetrate the system 300. The monoliths 302*a* and 302*b* may be half cylinder sections or half cylinders or composites and may be designed for more than one defeat mechanism. The dimensions of each component are optimized for the specific projectiles to be defeated.

The front face is mounted on a low density foam section 306. This allows movement of the front face when the projectile 312 impacts the front face. The movement reduces the amount of impact damage produced by the projectile 312. The low density foam 306 also provides a certain amount of rotation of the front face when the projectile 312 impacts the front face. The rotation is helpful in diverting the trajectory of the projectile 312 passing through an armor component making it easier to defeat at the second catcher stage.

The low density foam 306 is mounted on a metallic backing plate 308. The metallic backing plate 308 is mounted on a spall plate 310. The spall plate 308 can be an E-glass spall plate, a Kevlar spall plate, or other spall plate. The system 300 creates an array of hard and soft/tough regions with a length scale similar to that of the projectile to be defeated. Both light weight and the low cost particular placement of hard projectile-defeating structures of specific shape and size embedded in the tough (metal) matrix.

The armor system 300 also lends itself to cost reductions in several ways. First, the monoliths incorporated into the armor can be produced at much lower prices than the plates that are currently used with ceramic-faced armor. More importantly, by substituting natural occurring minerals for the highly processed ceramic it may be possible to dramatically reduce costs and very possibly improve performance.

Figure 4A:
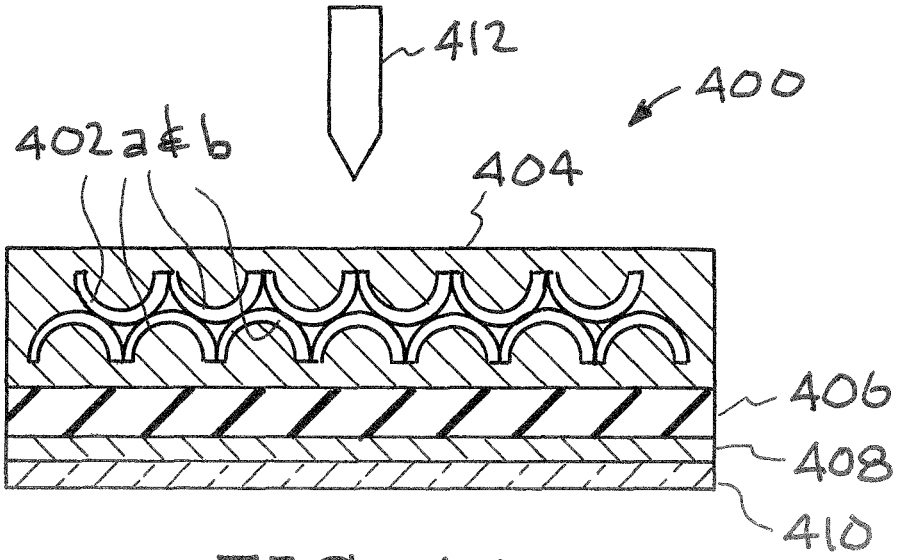
FIGS. 4A, 4B, & 4C illustrate another embodiment of the present invention.
Figure 4B:
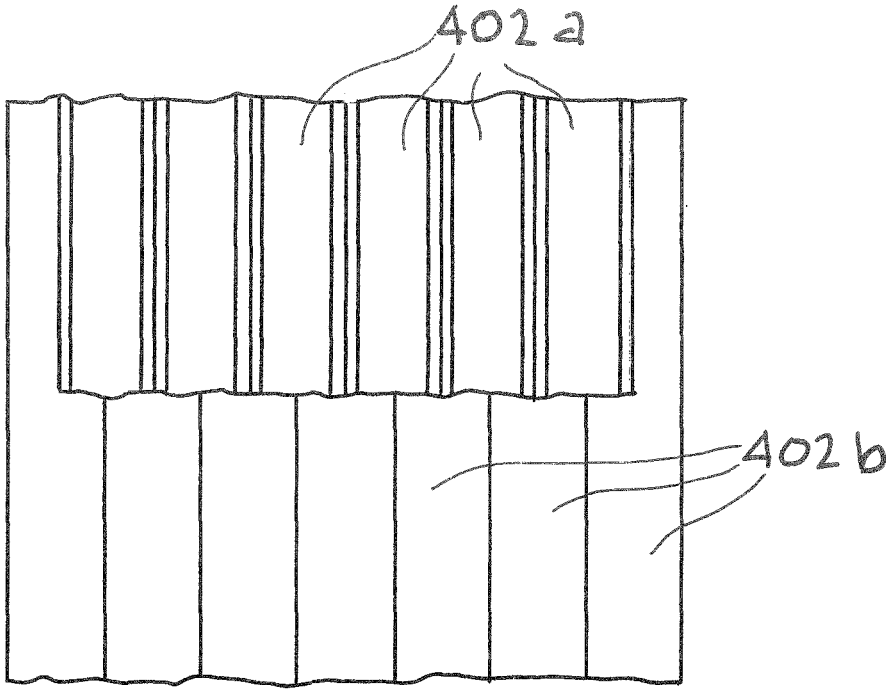
Figure 4C:
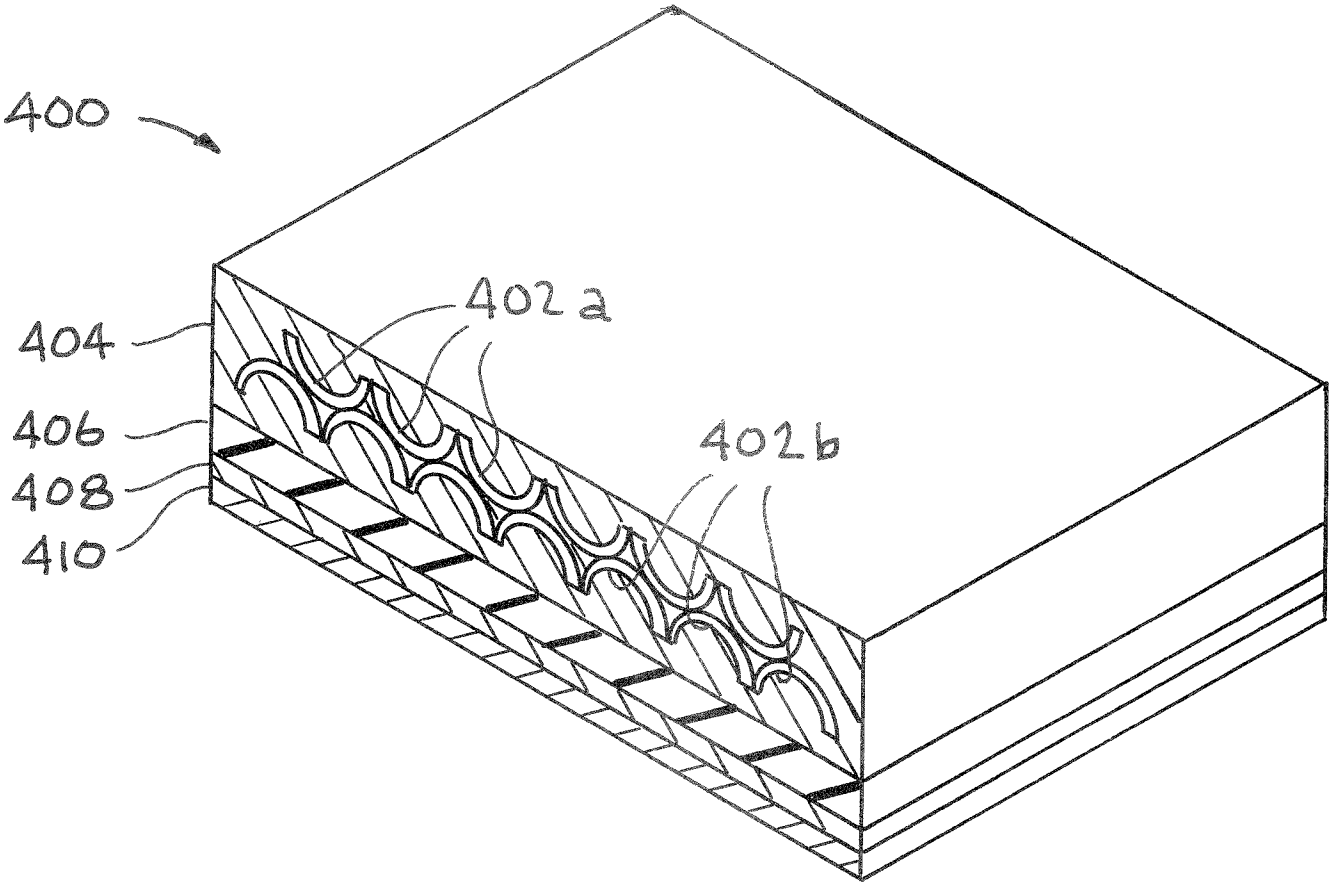

Referring now to FIGS. 4A, 4B, and 4C another embodiment of a complete lightweight low-cost armor system is illustrated schematically. The armor system of this embodiment is designated generally by the reference numeral 400. In the system 400, rather than a ceramic (i.e. hard component) plate facing on the outside, the hard material in the shape of monoliths 402*a* and 402*b* is embedded in the supporting tough matrix 404.

In the system 400, the front face is a composite fabricated from hard monoliths 402*a* and 402*b* (e.g. ceramic) imbedded in a tough matrix 404 (e.g. aluminum alloy) with the monoliths 402*a* and 402*b* positioned in a particular pattern. As shown in FIG. 4A, the crescent section monoliths 402*a* and 402*b* are arranged in rows in a stacking arrangement where there is overlapping of the crescent section monoliths 402*a* and 402*b*. As shown in FIG. 4B, this provides full coverage of the front face so that a projectile, such as a bullet 412, cannot penetrate the system 400. The monoliths 402*a* and 402*b* may be crescent sections or crescents or composites and may be designed for more than one defeat mechanism. The dimensions of each component are optimized for the specific projectiles to be defeated.

The front face is mounted on a low density foam section 406. This allows movement of the front face when the projectile 412 impacts the front face. The movement reduces the amount of impact damage produced by the projectile 412. The low density foam 406 also provides a certain amount of rotation of the front face when the projectile 412 impacts the front face. The rotation is helpful in diverting the trajectory of the projectile 412 passing through an armor component making it easier to defeat at the second catcher stage.

The low density foam 406 is mounted on a metallic backing plate 408. The metallic backing plate 408 is mounted on a spall plate 410. The spall plate 408 can be an E-glass spall plate, a Kevlar spall plate, or other spall plate. The system 400 creates an array of hard and soft/tough regions with a length scale similar to that of the projectile to be defeated. Both light weight and the low cost particular placement of hard projectile-defeating structures of specific shape and size embedded in the tough (metal) matrix.

The armor system 400 also lends itself to cost reductions in several ways. First, the monoliths incorporated into the armor can be produced at much lower prices than the plates that are currently used with ceramic-faced armor. More importantly, by using natural occurring minerals it is possible to dramatically reduce costs and improve performance.

Figure 5:
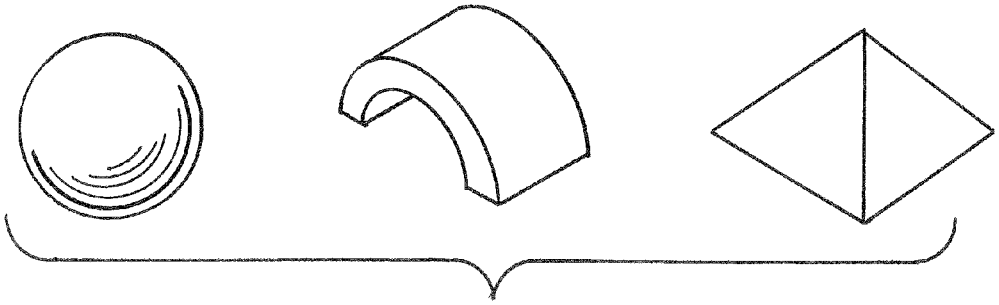
FIG. 5 shows examples of shapes that can be used as the monoliths.

Referring now to FIG. 5, examples of the shape of monoliths are shown. For example, shapes that can be used as the monoliths may be spheres, shells, cylinders, other shapes, or composites and may be designed for more than one defeat mechanism. Shape 501 illustrates a spherical monolith. The spherical monoliths having the shape 501 can be arranged in a stacking arrangement wherein of monoliths form one row and monoliths a second row. The rows provide overlapping of the spherical monoliths and are nested together in a manner that provides full coverage of the front face so that a projectile, such as a bullet, cannot penetrate the armor. The monoliths having the shape 501 may be spheres or composites and may be designed for more than one defeat mechanism. The dimensions of each component are optimized for the specific projectiles to be defeated.

Shape 502 illustrates a shell monolith. The shell monoliths having the shape 502 can be arranged in a stacking arrangement wherein of monoliths form one row and monoliths a second row. The rows provide overlapping of the shell monoliths and are nested together in a manner that provides full coverage of the front face so that a projectile, such as a bullet, cannot penetrate the armor. The monoliths having the shape 502 may be shells or composites and may be designed for more than one defeat mechanism. The dimensions of each component are optimized for the specific projectiles to be defeated.

Shape 503 illustrates a pyramid monolith. The pyramid monoliths having the shape 503 can be arranged in a stacking arrangement wherein of monoliths form one row and monoliths form a second row. The rows provide overlapping of the pyramid monoliths and are nested together in a manner that provides full coverage of the front face so that a projectile, such as a bullet, cannot penetrate the armor. The monoliths having the shape 503 may be shells or composites and may be designed for more than one defeat mechanism. The dimensions of each component are optimized for the specific projectiles to be defeated.

Figure 6A:
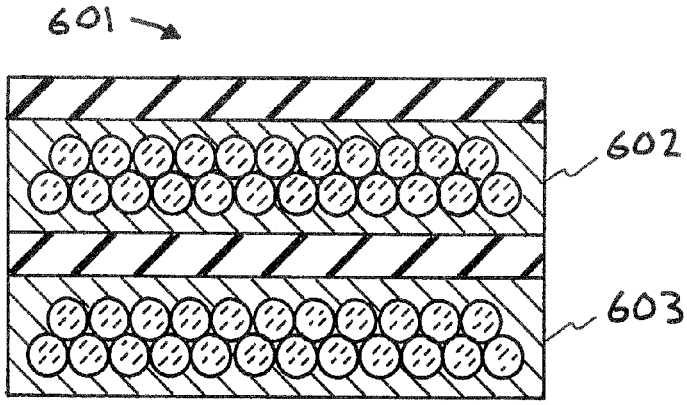
FIGS. 6A, 6B, and 6C show examples of stacked embodiments of monoliths in a matrix.
Figure 6B:
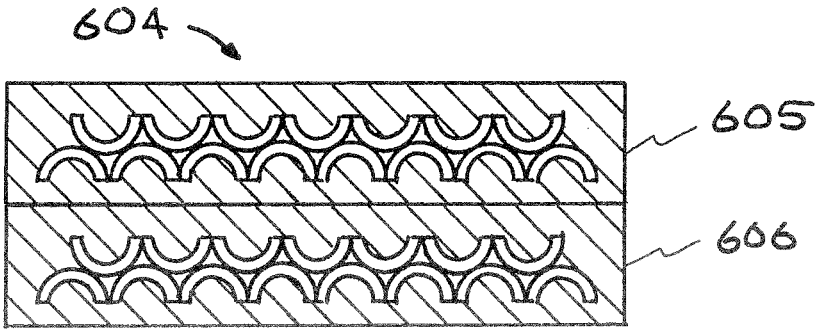
Figure 6C:
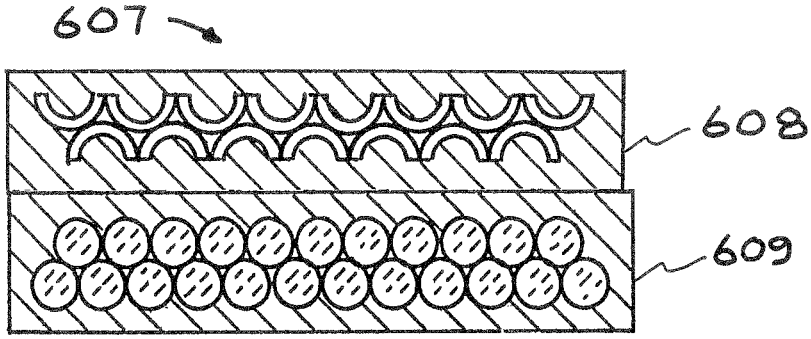

Referring now to FIGS. 6A, 6B, and 6C examples of stacked embodiments of monoliths in a matrix are shown. FIGS. 6A, 6B, and 6C show examples of shapes of monoliths in stacked embodiments.

As shown in FIG. 6A, an armor 601 can be produce with multiple units 602 and 603 having spherical monoliths are arranged in a stacking arrangement wherein unit 602 forms one element of the stack and unit 603 forms the second stack. The multiple units 602 and 603 having spherical monoliths are arranged in a stacking arrangement increased coverage and strength so that a projectile, such as a bullet, cannot penetrate the armor 601.

As shown in FIG. 6B, an armor 604 can be produce with multiple units 605 and 606 having shell monoliths are arranged in a stacking arrangement wherein unit 605 forms one element of the stack and unit 606 forms the second stack. The multiple units 605 and 606 having shell monoliths are arranged in a stacking arrangement increased coverage and strength so that a projectile, such as a bullet, cannot penetrate the armor 604.

As shown in FIG. 6C, an armor 607 can be produce with multiple units 608 and 609 having shell and spherical monoliths are arranged in a stacking arrangement wherein unit 608 having shell forms one element of the stack and unit 609 having spherical monoliths forms the second stack. The multiple units 608 and 609 having shell and spherical monoliths are arranged in a stacking arrangement increased coverage and strength so that a projectile, such as a bullet, cannot penetrate the armor 607.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An armor apparatus, consisting of:

a front face having a first layer of first spherical monoliths and a second layer of second spherical monoliths in a stacked arrangement forming a first row of said first spherical monoliths and a second row of said second spherical monoliths wherein said second spherical monoliths in said second row overlap said first spherical monoliths wherein said first spherical monoliths are first spherical monoliths made of flint aggregate material and wherein said second spherical monoliths are monoliths made of flint aggregate material, a matrix located around said first spherical monoliths and said second spherical monoliths wherein said matrix around said first spherical monoliths and said second spherical monoliths is an aluminum alloy matrix, a foam section located beneath said front face section and connected to said matrix, a metallic backing plate located beneath said foam section and connected to said foam section, and a spall plate located beneath said metallic backing plate and connected to said metallic backing plate.

2. A composite armor consisting of:

a first layer of first spherical monoliths and a second layer of second spherical monoliths in a stacked arrangement forming a first row of said first spherical monoliths and a second row of said second spherical monoliths wherein said second spherical monoliths in said second row overlap said first spherical monoliths wherein said first spherical monoliths are first spherical monoliths made of flint aggregate material and wherein said second spherical monoliths are monoliths made of flint aggregate material, a matrix located around said first spherical monoliths and said second spherical monoliths wherein said matrix around said first spherical monoliths and said second spherical monoliths is an aluminum alloy matrix, a foam section located beneath said second layer of second spherical monoliths and connected to said matrix, a metallic backing plate located beneath said foam section and connected to said foam section, and a spall plate located beneath said metallic backing plate and connected to said metallic backing plate.

* * * * *